United States Patent [19]

Mühling et al.

[11] 4,199,899

[45] Apr. 29, 1980

[54] WINDOW LIFTING MECHANISM

[75] Inventors: Günter Mühling; Hans-Peter Hess, both of Coburg, Fed. Rep. of Germany

[73] Assignee: Metallwerk Max Brose GmbH & Co., Coburg, Fed. Rep. of Germany

[21] Appl. No.: 936,571

[22] Filed: Aug. 22, 1978

[30] Foreign Application Priority Data

Aug. 26, 1977 [DE] Fed. Rep. of Germany ..... 2738672

[51] Int. Cl.[2] ..... E05F 11/48

[52] U.S. Cl. ..... 49/352; 49/360

[58] Field of Search ..... 49/227, 352, 360

[56] References Cited

U.S. PATENT DOCUMENTS

| | | | |
|---|---|---|---|
| 3,427,748 | 2/1969 | Marr | 49/352 |
| 3,681,874 | 7/1972 | Golde et al. | 49/352 |
| 4,004,371 | 1/1977 | Podolan et al. | 49/352 |
| 4,090,329 | 5/1978 | Rampel | 49/352 |

*Primary Examiner*—Kenneth Downey

*Attorney, Agent, or Firm*—Toren, McGeady and Stanger

[57] ABSTRACT

In a window lifting mechanism for a motorcar window and the like in which a carrier for the window is moved along a guide by bowden cables led from the guide to a drive mechanism in partly arcuate paths, the end sections of the bowden cable casing are connected to the guide by connectors which are unitary pieces of sheet metal including an approximately planar main portion and guide and fastening elements stamped out of the main portion and angularly offset from the same for engagement with the associated casing section.

9 Claims, 5 Drawing Figures

Fig.1
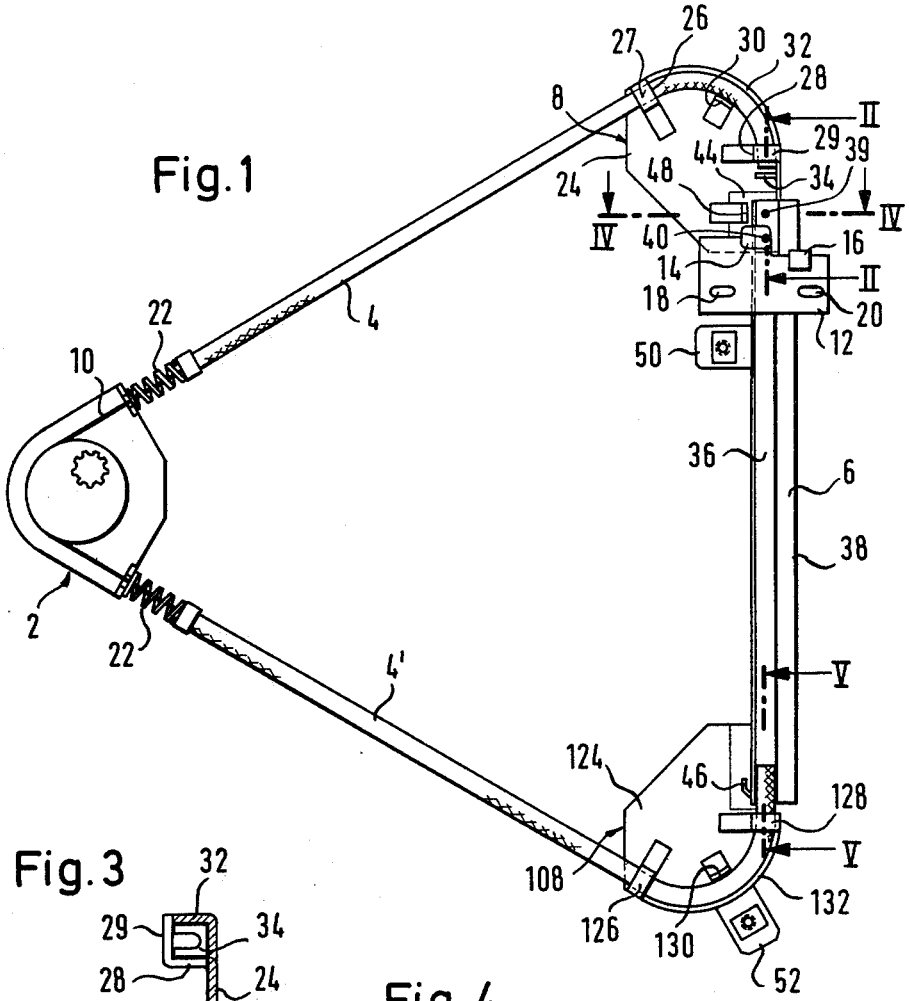
Fig.3
Fig.2
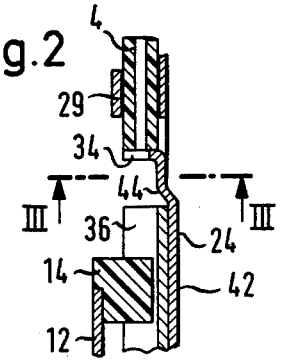
Fig.4
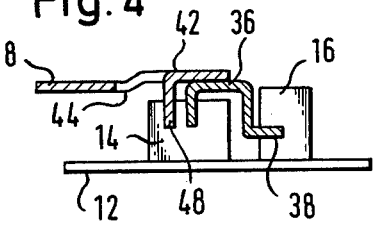
Fig.5
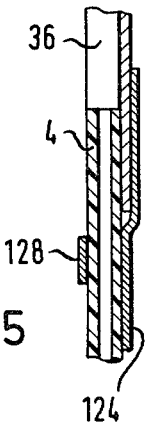

WINDOW LIFTING MECHANISM

This invention relates to window lifting mechanisms of a type suitable for windows in motorcar doors, and particularly to an improvement in the lifting mechanism described and claimed in the commonly owned U.S. Pat. No. 4,090,329.

In the known window lifting mechanism, a carrier for the window is moved along a tubular guide by a driven bowden cable assembly whose wire or cable component is deflected into the direction of elongation of the guide in an arcuate path defined by the bore of a casing. The latter is held in the necessary position and attached to the guide by suitable connector assemblies. The arrangement of the earlier patent, only briefly sketched in the preceding sentences, has been proven effective in providing trouble-free operation of the lifting mechanism over extended periods, wear of movable components being reduced to a minimum.

It is a shortcoming of the earlier invention that the connector assemblies and other components are relatively complex and accordingly costly to build. It is a primary object of this invention to improve the known window lifting mechanism by connectors which are as effective in extending the useful life of the movable mechanism elements, but which may be built in mass production at very low cost.

The invention, in its more specific aspects, resides in a window lifting mechanism in which at least one of the two connector assemblies necessary in the known mechanism is replaced by a connector which is a unitary piece of sheet metal. Respective parts of this piece constitute a substantially planar main portion of the connector and guide and fastening elements angularly offset from the main portion for engagement with the associated bowden casing section for fastening the section to the connected guide in a position in which the casing section defines therein an arcuate path of movement for a terminal portion of the tension member of the bowden cable assembly which is usually a wire or cable.

Other features, additional objects, and many of the attendant advantages of this invention will readily be appreciated as the same becomes better understood by reference to the following detailed description of a preferred embodiment when considered in connection with the appended drawing in which:

FIG. 1 shows a window lifting mechanism of the invention in side elevation;

FIG. 2 illustrates a portion of the mechanism of FIG. 1 in enlarged section on the line II—II;

FIG. 3 is a fragmentary sectional view of the device of FIG. 2 taken on the line III—III;

FIG. 4 illustrates the mechanism of FIG. 1 in enlarged, fragmentary section on the line IV—IV; and FIG. 5 shows a portion of the mechanism of FIG. 1 in enlarged section on the line V—V.

Referring now to the drawing in detail, and initially to FIG. 1, there is shown a lifting mechanism for the window in a door of a passenger car or like vehicle, the door and window being attached to the illustrated mechanism in a conventional manner, partly referred to hereinbelow. The mechanism is operated manually or by means of a motor through a conventional drive 2 from which two bowden cable casings 4, 4' diverge toward the ends of a rigid, elongated guide 6. Depending on the shape and desired path of movement of the associated window pane, the guide may be straight or arcuate in a longitudinal plane perpendicular to the plane of the drawing, as is conventional in itself. The ends of the casings 4, 4' remote from the drive 2 are connected with the two ends of the guide 6 by connectors 8, 108. The two ends of a bowden cable 10 are attached to a window carrier 12 longitudinally slidable on the guide 6 and pass through the casings 4, 4' toward the drive 2. Plastic guide shoes 14, 16 on the window carrier 12 engage the guide 6. Fasteners normally pass through holes 18, 20 and corresponding holes in a window or window frame, not shown, so that the window is raised or lowered when the bowden cable 10 is moved longitudinally by the drive 2.

Helical compression springs 22 enveloping the bowden cable 10 are arranged between the casings 4, 4' respectively and the shell of the drive 2 which is normally fixed on the associated door. The springs 22 maintain a practically uniform tension in the bowden cable 10 for reliable operation of the lifting mechanism and reduced wear of its movable components.

The connector 8 is a unitary piece of sheet metal of practically uniform thickness. Its main portion 24 is planar, and all other elements of the connector 8 are integrally connected with the main portion and formed therewith from an originally flat blank by stamping and bending. The casing 4 is guided on the main connector portion 24 in an approximately circular arc between two clips 26, 28 constituted by respective stamped lug portions of the connector 8 which are bent out of the plane of the main portion 24 at right angles, the free end 29 of each lug portion then being bent into a plane parallel to that of the main portion 24, as is best seen in FIG. 3 with reference to the clip 28. The rectangular passage partly bounded by each lug portion and the main portion 24 is bounded radially outward relative to the arcuate portion of the casing 4 by an arcuate flange portion 32 of the connector, the radial position of the casing 4 in an inward direction being defined by a small integral lug 30 projecting at right angles from the main portion 24. The flange portion 32 materially contributes to the rigidity of the connector 8.

A forked abutment 34 is bent out of the plane of the main connector portion 24 spacedly adjacent the clip 28 to limit sliding movement of the casing 4 in the clips 26, 28 under the force of the spring 22 and other applied stresses. The clips themselves, however, may envelop the casing 4 sufficiently tightly to prevent longitudinal movement of the same. The bowden cable 10 passes freely between the two tines of the abutment 34 in a manner evident from, though not specifically illustrated in FIGS. 2 and 3.

The free end of each casing 4, 4' remote from the drive 2 is longitudinally aligned with the guide 6 so that the cable 10 enters and leaves the guide 6 smoothly, the cable having been omitted from the showing of FIGS. 2 to 5 and of a portion of FIG. 1 in order not to crowd the drawing.

As is best seen in FIG. 4, the guide 6 consists of a rectangular channel 36 provided with a flat rail 38 that extends outward of the channel cavity from the free edge of one channel flange and is parallel to the web of the channel. The guide 6 is preferably made of a unitary body of sheet metal in a simple bending operation and is of uniform thickness throughout if so manufactured, as is shown in FIG. 4.

The guide shoes 14, 16 on the window carrier 12 consist of nylon or like synthetic resin composition having a low coefficient of friction on the metal of the guide 6. Edges of one of the guide flanges and of the rail 38 are received in respective slots of the guide shoes which are perpendicular to each other. The two ends of the cable 10 are attached to the window carrier 12 in a non-illustrated, conventional manner, as by clamps. The channel 36 is spot-welded to a planar portion 42 of the connector 8 which is transversely offset from the main portion 24 by a double bend 44, two welds 39, 40 being indicated in FIG. 1.

The available stroke of the carrier 12 is normally limited by abutting engagement of the associated, non-illustrated window by a window frame or the like. The stresses on the window lifting mechanism resulting from the force of the mechanism 2 applied against the resistance of the stopped window may cause premature wear of the mechanism, and it is preferred to provide additional stops for the carrier 12. One stop 46 is integrally bent out of one of the flanges of the channel 36 into the path of the carrier 12 near the lower end of the guide 6. Another stop 48 is bent out of the offset portion 42 of the connector 8 into the path of the guide shoe 14, as is best seen in FIG. 4, to limit upward window movement. The connector 8 including the main portion 24, clips 26, 28, lug 30, flange 32, abutment 34, and stop 48 may thus be shaped in a single stamping operation from a unitary piece of sheet metal. Except for the flange 32, stamping and bending of the integral guide and fastening elements out of the main portion 24 leaves contiguously adjacent openings in the main portion which are similar in shape and dimensions to the angularly offset elements. While the stop 46 shown on the guide 6 requires a separate operation to be performed on the guide, the stop 46 may be formed integral with the connector 108 if so preferred, permitting the guide 6 to be cut from a continuous length of stamped metal without requiring any secondary shaping operations.

The connector joining the casing 4' to the guide 6 may be a mirror image of the connector 8 described above in detail. The connector 108 illustrated in FIGS. 1 and 5 is somewhat simpler, and its mirror image may replace the illustrated connector 8.

The planar main portion 124 of the connector 108 carries two integral clips 126, 128 which envelop respective longitudinal sections of the casing 4' in the manner described with reference to the clips 26, 28, and the arcuate portion of the casing 4' which leads the non-illustrated cable 10 into the cavity of the guide 6 is confined between an integral lug 130 and a flange 132 of the connector 108. In the absence of a forked abutment guiding the cable into the channel 36, the casing 4' extends a short distance into the channel cavity and is secured in its illustrated longitudinal position by at least one of the clips 126, 128.

The window lifting mechanism is normally attached to the associated car door by means of self-threading screws engaging a lug 50, which is spot-welded to the channel 36, and a lug 52 stamped integrally out of the same piece of sheet metal which constitutes the main portion 124 of the connector 108 and its various other elements.

The illustrated guide 6 and connectors 8, 108 are stampings prepared from sheet metal stock of the same thickness and spot-welded to each other as shown at 39, 40, but not specifically illustrated with respect to the connector 108. If the number of identical lifting mechanisms to be produced warrants the necessary tooling costs, the guide 6 and the connectors 8, 108 may be formed as a unitary piece of material from a single sheet metal blank.

The illustrated bowden casing 4, 4' consists of synthetic resin composition reinforced by an outer fabric shell as is conventional. It may be replaced by spiral wire sheath, as is equally known. The cable 10 may be replaced by any other suitable tension member such as a simple wire or plastic string.

It should be understood, therefore, that the foregoing disclosure relates only to a presently preferred embodiment of the invention, and that it is intended to cover all changes and modifications of the example of the invention chosen herein for the purpose of the disclosure which do not constitute departures from the spirit and scope of the invention set forth in the appended claims.

What is claimed is:

1. In a window lifting mechanism including an elongated guide member, a window carrier member longitudinally movable on the guide member, two connectors connecting respective longitudinal end portions of said guide member to two associated tubular casing sections, two longitudinally terminal portions of at least one elongated tension member being fastened to said window carrier member and extending therefrom into said casing sections respectively, and drive means for longitudinally moving said at least one tension member relative to said guide member and for thereby moving said carrier member, the improvement in at least one of said connectors which consists in said connector being a unitary piece of sheet metal, respective parts of said piece constituting a substantially planar main portion of said one connector and guide and fastening elements angularly offset from said main portion for engagement with the casing section associated with said one connector for fastening said casing section to said guide member in a position in which said casing section defines therein an arcuate path of movement for the corresponding terminal portion of said at least one tension member, said planar main portion being located along the portion of said casing section defining said arcuate path of movement.

2. In a mechanism as set forth in claim 1, said fastening elements including an abutment aligned with said casing section in the direction of elongation of said guide member for limiting movement of said casing section in said direction.

3. In a mechanism as set forth in claim 1, a further part of said piece extending into the path of movement of said carrier member on said guide member transversely to said main portion and constituting a stop limiting movement of said carrier member on said guide member.

4. In a mechanism as set forth in claim 1, said main portion being formed with a plurality of openings therein respectively contiguous to associated ones of said guide and fastening elements, the shapes and dimensions of said openings being substantially similar to the respective shapes and dimensions of the associated guide and fastening elements.

5. In a mechanism as set forth in claim 1, one of said guide elements being elongated in an arc substantially parallel to said arcuate path of movement and engaging said casing section.

6. In a mechanism as set forth in claim 1, said guide member including a channel portion having a web and two flanges spacedly projecting from said web in a common direction, a guide shoe being formed with a slot receiving one of said flanges for sliding movement longitudinally of said guide member, said shoe being fixedly fastened to said window carrier.

7. In a mechanism as set forth in claim 1, another guide shoe fixedly fastened to said window carrier and formed with a slot transverse to the slot receiving said one flange, the other flange of said channel portion carrying an integral rail received in said transverse slot.

8. In a mechanism as set forth in claim 1, fastening means for fastening said one connector to supporting structure, said fastening means including a fastening lug constituted by a part of said unitary piece of sheet metal.

9. In a mechanism as set forth in claim 1, said guide member being a unitary body of sheet metal, a part of said unitary body constituting a fastening lug for fastening said guide member to supporting structure.

* * * * *